US007302212B2

(12) United States Patent
Leute

(10) Patent No.: US 7,302,212 B2
(45) Date of Patent: Nov. 27, 2007

(54) FILTER FOR REPLENISHER TONER PARTICLES

(75) Inventor: Gerardo Leute, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 186 days.

(21) Appl. No.: 11/194,271

(22) Filed: Aug. 1, 2005

(65) Prior Publication Data

US 2007/0025774 A1 Feb. 1, 2007

(51) Int. Cl.
*G03G 15/08* (2006.01)

(52) U.S. Cl. ..... 399/258; 399/260; 399/262

(58) Field of Classification Search ..... 222/DIG. 1; 399/119, 120, 258, 259, 260, 262, 263
See application file for complete search history.

(56) References Cited

U.S. PATENT DOCUMENTS 4,054,381 A 10/1977 Bernhard
4,389,968 A 6/1983 Satomura
4,561,759 A 12/1985 Knott
4,614,165 A 9/1986 Folkins et al.
4,868,600 A 9/1989 Hays et al.
4,984,019 A 1/1991 Folkins
5,010,367 A 4/1991 Hays
5,063,875 A 11/1991 Folkins et al.
5,200,788 A 4/1993 Thayer
5,436,703 A 7/1995 DeYoung et al.
5,600,411 A 2/1997 Hart
5,710,960 A * 1/1998 Hart et al. ..... 399/253
6,129,216 A 10/2000 Vandewinckel et al.
6,353,722 B1 3/2002 Klimley et al.
7,099,610 B2 * 8/2006 Matsuzaki ..... 399/279

* cited by examiner

*Primary Examiner*—Hoang Ngo
(74) *Attorney, Agent, or Firm*—Maginot, Moore & Beck

(57) ABSTRACT

An electrographic printer is disclosed including a replenisher system for replenishing developer material in a development chamber by transferring replenisher from a replenisher supply source through an opening into a transporter in communication with the replenisher supply source and the chamber having a filter disposed between the replenisher supply source and the transporter to limit the size of particles passing from the replenisher supply source to the transporter. A filtered replenisher cartridge and method of supplying replenisher with a refilled replenisher cartridge are also disclosed.

20 Claims, 7 Drawing Sheets

FILTER FOR REPLENISHER TONER PARTICLES

BACKGROUND AND SUMMARY

The present invention relates to a developer apparatus for electrophotographic printing. More specifically, the invention relates to a filter for filtering toner.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced.

The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image.

In an electrophotographic printer as the toner material is transferred to the photoreceptor and eventually to the copy paper, this used toner must be replaced. The electrophotographic printer thus includes one or both of a device for recapturing toner cleaned from the charge retentive surface and a device for replenishing toner from which fresh toner is dispensed into the machine.

Several devices are known for filtering recycled toner cleaned from the charge retentive surface. U.S. Pat. No. 5,200,788 discloses a brush auger reclaim filtration assembly incorporated into an open ended chamber. The brush auger is a toner reclaim filtration device that is rotatably mounted, in the chamber, to move toner and debris along a separating screen. Also contained in the housing is a mounted transport auger that rotates as it moves the reclaimed toner to the development housing.

U.S. Pat. No. 4,389,968 discloses a toner regenerating device with a mesh disposed in the route of the toner collected from an image bearing member. The device includes an apparatus for imparting to the collected toner through the mesh a force causing the collected toner to move along the mesh. The collected toner on the mesh containing foreign material and solidified toner is loosened so that the solidified toner is divided into fine particles. The foreign matter is caused to float up over the collected toner and prevented from passing through the mesh. The device includes a transporter for carrying toner to and into a chamber through a first opening. Toner in the chamber is moved out of a second opening. An elastic plate is mounted at one of its ends for rotation within the chamber such that its opposite tip end is maintained in contact with the interior wall of the chamber except at the second chamber opening.

U.S. Pat. No. 4,054,381 discloses a toner filter arrangement adapted for use in a cleaning station of a electrophotographic reproduction machine. Foreign material and other contaminants are removed from residual toner prior to its collection in a disposable or reuse container or return to the developer station. The filter arrangement comprises a housing having an input opening through which removed toner enters and an output opening through which filtered toner exits. The housing includes a spiral brush mounted for rotation on a shaft centrally located within the housing and a stationary open mesh screen coaxially located with respect to the shaft. Rotation of the brush operates to sift toner through the screen to the outlet of the filter housing.

In earlier copy machines and printers, toner used in the developer unit was replenished by pouring loose toner into a toner container. In using this replenishing method at least two major problems occurred. The first problem was that a portion of the loose toner could either be spilled during filling or the loose toner would form a cloud when filling and settle later. In either case the spilled or settled toner could contaminate the machine or printer and require an expensive service call. The second problem was that contamination could enter the toner container during fill and negatively affect the operation of the machine. U.S. Pat. No. 4,561,759 discloses a device for filling and filtering toner from a supply container which is placed by an operator in communication with a feed container in a photocopier. The device has a cylindrical filling opening for the feed container with a cross section such that the supply container can be inverted. The device has a filter basket disposed in the region of the filling opening which is closed from the feed container by a filter mesh. An electric vibrator is connected to the device.

In more recent copy machines and printers, toner used in the developer unit is replenished by exchanging an empty toner replenishment cartridge with a new, full replenishment cartridge. Many devices have been used to seal the replenishment cartridge prior to installation in the machine. These devices and others have been used to maintain the sealed integrity of the replenishment cartridge during the exchange of an empty replenishment cartridge for a full replenishment cartridge. The use of replenishment cartridges has reduced the problems with spilled and settled toner as well as contamination problems during toner replenishing. To provide for a small compact replenishment cartridge and to provide for a replenishment cartridge in which the opening to the replenishment cartridge may be easily removed, the replenishment cartridge typically has a compact shape with a small opening from which at least toner is dispensed.

While the use of replenishment cartridges for the storage and refilling of toner within a machine reduces the contamination encountered during filling, even in the most stringently controlled manufacturing environments, contaminants may enter the toner itself during its manufacture and/or could enter the replenishment cartridge during filling at the factory and later progress into the developer housing causing copy quality problems. If the contamination, particularly in the form of fibers or oversized materials (debris, flakes, etc.), reaches the developer housing, copy quality and machine reliability suffer.

The development system, the area of the electrophotographic printer where the toner is transferred to the photoreceptor, typically includes a wide area extending across the full width of the photoreceptor in order that a full image width may be developed. The toner must thus progress from the replenishment container into the developer housing and progress along the full width of the developer housing in order that the full width of the latent image may be developed. Furthermore, in attempts to make inexpensive and compact electrophotographic printers and to minimize space and related costs, the location of the toner replenishment cartridge and the developer housing may be far apart.

To aid in transferring toner in the developer housing to the photoreceptor, the toner particles are often mixed with carrier particles. The use of smaller carrier and toner particles, which are typical when using colored toners for color electrophotography compounds problems associated with contamination. Imperfections in color copies, such as those caused by contamination, are often more noticeable to the human eye than imperfections in monochromic copies.

The presence of contamination in development systems utilizing hybrid scavengeless development is particularly a concern. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al. U.S. Pat. No. 4,868,600 is incorporated herein by reference.

In a scavengeless development system, toner is detached from a donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color electrophotography. The small color toner and related carrier particles used for the implementation of these devices and the greater visual scrutiny given to color copies compound contamination problems. Furthermore, the electrode wires utilized to form the toner powder cloud are particularly susceptible to contamination in general and in particular, to contamination from fibers or oversized materials (debris, flakes, etc.).

One familiar type of development of an electrostatic image is called "two-component development". Two-component developer material largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere to the electrostatic latent image.

U.S. Pat. No. 4,614,165, assigned to the assignee hereof, discloses the general principle of what is known familiarly as "trickle" development. Very briefly, trickle development involves providing two distinct supplies of toner and carrier particles. The first supply, referred to herein as developer material, is initially present in the developer housing. The developer unit draws toner from the developer material for application to the electrostatic latent image. The second supply of toner and/or toner and carrier particles, referred to herein as replenisher or a replenishment supply, is separate from the developer material and is often present in a replenishment bottle, hopper, cartridge or other container. The replenishment supply is used to replenish the first supply over time by adding toner or toner and carrier particles as the toner or toner and carrier particles are depleted from the first supply. Thus, upon introduction into the developer housing the toner or toner and carrier particles of the replenishment supply become toner and carrier particles of the development material. Typically, the developer material and replenishment supply have substantially different ratios of toner to carrier.

Many printer systems are sensitive to oversized particle contamination in the developer housing. Toner flakes made during the normal toner filling process, as well as fibers or oversized materials (debris, flakes, etc.) already present in the bottle received from the manufacturer, may cause image quality problems, such as streaking of the printed output, in such sensitive printer systems. Currently oversized contamination issues are addressed minimizing or eliminating fibers or oversized materials (debris, flakes, etc.) introduction or formation in the toner manufacturing and filling process. Also, manufacturers attempt to address oversized contamination issues by attempting to eliminate any sources of foreign contamination in the empty bottles during their assembly process.

In addition to, or instead of, the above described filtering systems, users of electrostatographic printing systems would appreciate a filter for filtering toner or toner and carrier as it is removed from a replenishment supply.

The disclosure describes a method and device for containing oversized toner and contaminant flakes within a replenishment supply, such as a replenisher bottle, during use. The disclosed method and device inhibit fibers or oversized materials (debris, flakes, etc.) from entering the replenisher dispense system within the printer system. This reduces the number of streaks that the printer system experiences improving customer satisfaction. The disclosed apparatus utilizes an internal screen to inhibit oversized materials (debris, flakes etc.) from exiting the replenishment supply during use. The screen covers the opening of the auger of the replenisher dispense system that is used by the machine to extract replenisher from the replenishment supply, thereby inhibiting these particles from leaving the replenishment supply and being introduced into the developer material.

According to one aspect of the disclosure, an apparatus for developing an electrostatic latent image employed in a printing machine comprises a photoreceptor, a developer unit, a replenisher supply source, a replenisher transporter and a filter. The photoreceptor is configured to receive a latent image thereon, to attract toner particles to the latent image and to transfer attracted toner particles to a substrate. The developer unit is positioned relative to the photoreceptor to permit toner to be transferred to the photoreceptor. The developer unit includes a developer housing defining a chamber containing an initial supply of developer material including toner particles and a toner transfer system for transferring toner particles present in the housing to the photoreceptor. The replenisher supply source contains replenisher comprising toner particles. The replenisher transporter is in communication with the replenisher supply source through an opening and in communication with the chamber of the developer housing for transporting replenisher from the replenisher supply source to the chamber of the developer housing. The filter is disposed between the replenisher supply source and the chamber of the developer housing. The filter is configured to limit the size of particles discharged from the replenisher supply source and entering the chamber of the developer housing.

According to another aspect of the disclosure, a replenisher cartridge for supplying replenisher to a developer unit of an electrophotographic printing machine comprises a container, a supply of replenisher and a filter element. The container is configured for communication with a replenisher transporter communicating with a chamber of the developer unit. The replenisher transporter has an opening for communicating with the interior of the container. The supply of replenisher comprises toner disposed in the container. The filter element is disposed relative to the opening to filter replenisher passing through the opening.

According to yet another aspect of the disclosure, a method of providing replenisher for replenishing development material utilized in developing an electrostatic latent image recorded on a photoconductive member employed in an electrophotographic printing machine including a replenisher transporter is disclosed. The method includes several steps not necessarily performed in the order presented unless otherwise indicated. In an opening step, a filtered replenisher cartridge is opened. The replenisher cartridge includes a seal cap for sealing an opening through which the cartridge communicates with the replenisher transporter when the seal cap is dislodged from the opening and a portion of the replenisher transporter is received through the opening and a filter for filtering particles entering the replenisher transporter. The opened filtered replenisher cartridge has been removed from an electrophotographic printing machine including a replenisher transporter. The method also includes a filling step wherein the replenisher cartridge is filled with replenisher comprising toner particles. The method also includes a positioning step wherein the seal cap is positioned to seal the opening through which the cartridge communicates with the replenisher transporter Additional features and advantages of the presently disclosed filter for toner particles will become apparent to those skilled in the art upon consideration of the following detailed description of embodiments exemplifying the best mode of carrying out the disclosed apparatus as presently perceived.

BRIEF DESCRIPTION OF THE DRAWINGS

A more complete understanding of the disclosed apparatus can be obtained by reference to the accompanying drawings wherein.

Corresponding reference characters indicate corresponding parts throughout the several views. Like reference characters tend to indicate like parts throughout the several views.

DETAILED DESCRIPTION

Figure 1:
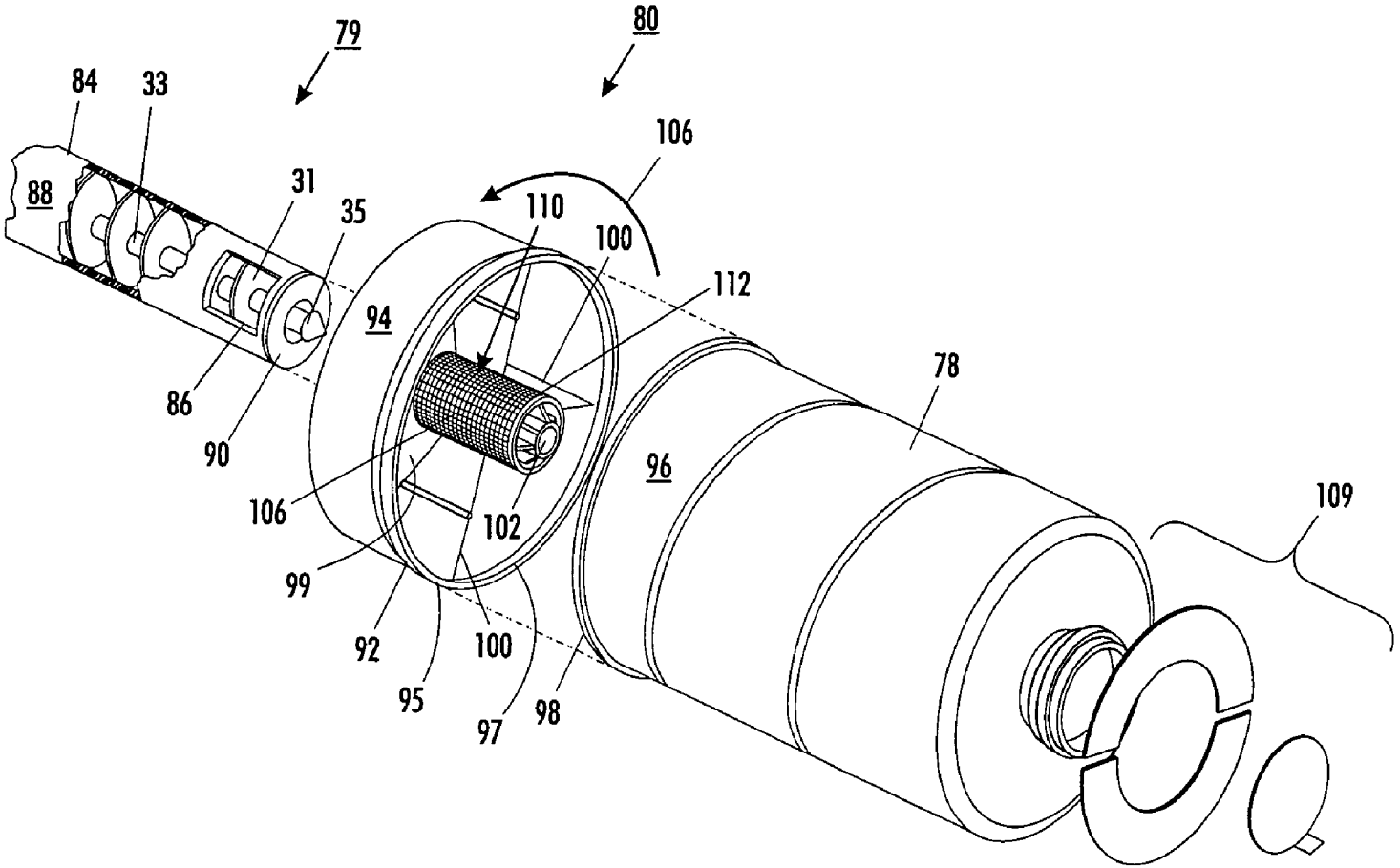
FIG. 1 is a partially exploded view of the filtered replenisher cartridge including a bottle dispense assembly, a seal cap, a replenisher bottle, a filter element and a refill assembly and an end of a replenisher transporter of the developer unit having a transfer conduit with an auger disposed therein showing the filter element seated in the dispense assembly and the seal cap shown in a dislodged positioned as if a portion of the replenisher transporter were received in the replenisher cartridge.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

Inasmuch as the art of electrophotographic printing is well known, the various processing stations employed in the FIG. 7 printing machine will be shown hereinafter schematically and their operation described briefly with reference thereto.

Figure 7:
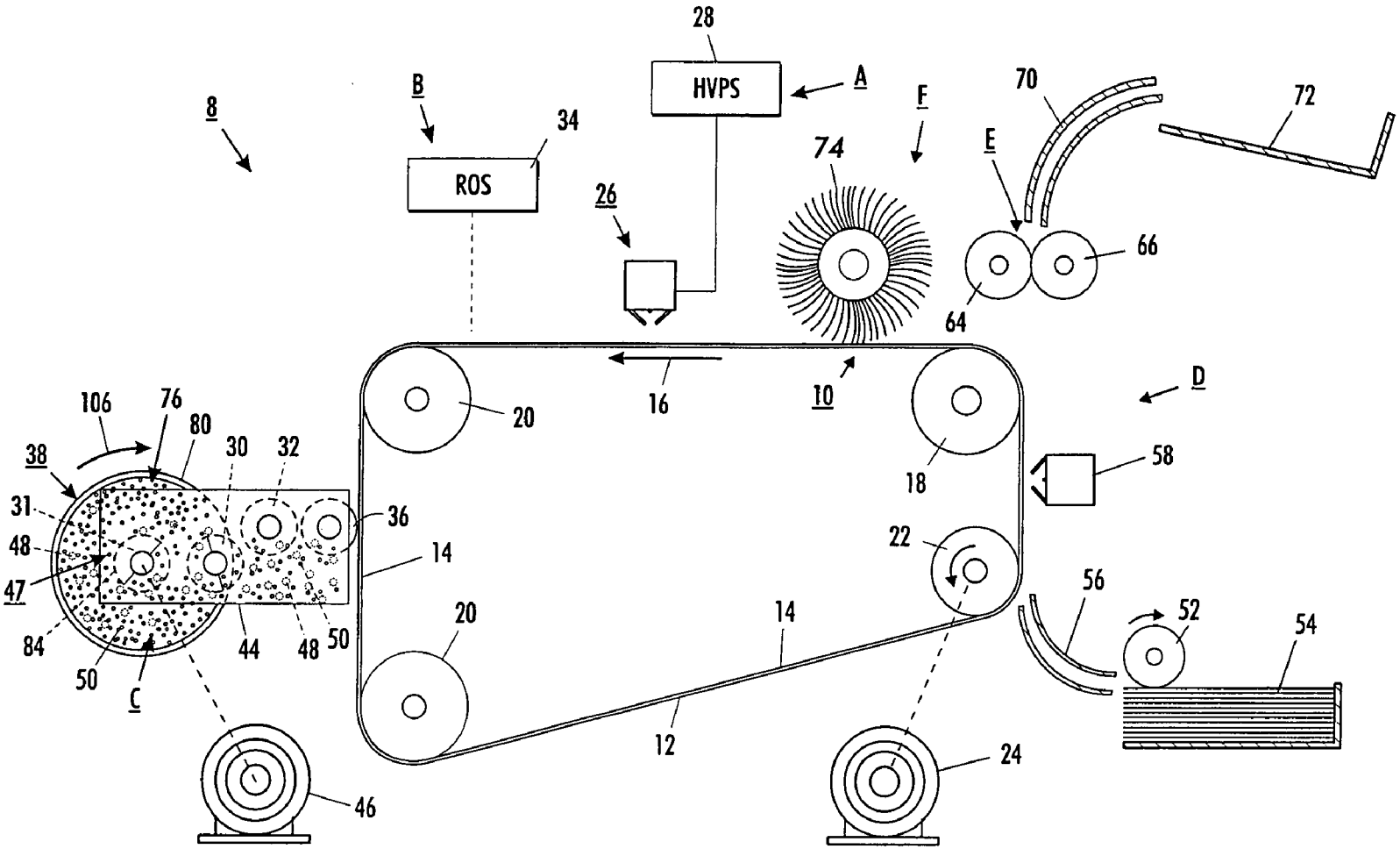
FIG. 7 is a diagrammatic view of an illustrative electrophotographic printing machine incorporating a development apparatus having a filter for toner particles.

Referring initially to FIG. 7, there is shown an illustrative electrophotographic printing machine 8 incorporating the disclosed filtered replenishment supply cartridge 80 therein. The printing machine incorporates a photoreceptor 10 in the form of a belt having a photoconductive surface layer 12 on an electroconductive substrate 14. Preferably, the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

Next, the charged portion of photoconductive surface 12 is advanced through exposure station B. At exposure station B, the ROS 34 lays out the image in a series of horizontal scan lines with each line having a specified number of pixels per inch. The ROS 34 includes a laser and a rotating polygon mirror block associated therewith. The ROS 34 exposes the charged photoconductive surface 12 of the photoreceptor 10.

After the electrostatic latent image has been recorded on photoconductive surface 12, the motion of the belt 10 advances the latent image to development station C as shown in FIG. 7. At development station C, one or more development systems 38, develops the latent image recorded on the photoconductive surface 12. The chamber in developer housing 44 stores a supply of developer material 47. The developer material 47 may be, as shown in FIG. 7, a two component developer material of at least magnetic carrier granules 48 having toner particles 50 adhering triboelectrically thereto. It should be appreciated that the developer material 47 may likewise comprise a one component developer material consisting primarily of toner particles 50.

Again referring to FIG. 7, after the electrostatic latent image has been developed, the motion of the belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine 8 by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the filtered replenishment supply cartridge 80 of the present disclosure therein.

Referring again to FIG. 7, in order to provide a constant supply of at least toner 50 to replace that consumed in the developing of the latent image, the development systems 38 include a cartridge 80 for storing a replaceable supply of replenisher 76 in a replenisher supply source, such as a replenisher bottle 78, including at least toner 50. The replenisher 76 may contain carrier granules 48 as well as toner particles 50 in order to replace worn and broken carrier granules 48. It should be appreciated however that the filtered replenishment supply cartridge 80 may contain replenisher 76 including only toner 50. As the typical usage of toner 50 is larger than the typical usage of carrier granules 48 (on a weight basis) whether on a per copy or per hour basis, the ratio of toner 50 to carrier 48 in the cartridge 80 is much larger than the ratio of toner 50 to carrier 48 in the developer material 47 contained in the developer housing 44. The use of replenisher 76 containing carrier particles 48 as well as toner 50 is disclosed in U.S. Pat. No. 4,614,165 to Folkins et al. which is incorporated herein by reference.

The cartridge 80 is a replaceable item that can be made of any suitable durable material. The illustrated cartridge 80 is configured to mate with a replenisher transporter 79 that includes an auger 31 disposed within a transfer conduit 84 for extracting the replenisher 76 from the replenisher cartridge 80 and transferring the replenisher 76 to the development housing 44 for addition to the developer material 47 contained therein. While the disclosed filtered replenishment supply cartridge 80 utilizes a replenisher transporter 79 having an auger 31 and a transfer conduit 84, it is within the scope of the disclosure for particles in the replenishment supply cartridge 80 to progress to a toner sump or developer sump which may be located above the development housing 44 whereby gravity may feed the replenisher 76 from the sump.

The overall function of development system 38 is to apply marking material, such as toner, onto suitably-charged areas forming a latent image on an image receptor such as photoreceptor belt 10 (a portion of which is shown), in a manner generally known in the art. In various types of printers, there may be multiple such developer systems 38, such as one for each primary color or other purpose.

Among the elements of the developer system 38 shown in FIG. 7, which are typical of developer systems of various types, are a developer housing 44, which functions generally to hold a supply of developer material 47, as well as augers such as 30, 31, 32, which variously mix and convey the developer material 47, recovered developer material and replenisher 76, and a magnetic roll 36, which in this embodiment forms a magnetic brush to apply toner 50 extracted from the developer material 47 to the photoreceptor 10. A motor 46 is illustrated that is coupled to provide rotational motion to the various augers 30, 31, 32, the replenishment cartridge 80 coupled to auger 31 and the magnetic roll 36. Those skilled in the art will recognize that the various augers 30, 31, 32, the replenishment cartridge 80 coupled to auger 31 and the magnetic roll 36 may be driven by separate motors or may be driven by motor 24 within the scope of the disclosure.

Other types of features for development of latent images, such as donor rolls, paddles, scavengeless-development electrodes, commutators, etc., are known in the art and could be used in conjunction with various embodiments pursuant to the claims. While the illustrated embodiment shows only one magnetic roll 36, it is common for developer units to include two or more magnetic rolls. As mentioned above, in many embodiments of developer systems 38, a two-component developer material 47 is used, comprising toner 50 and carrier 48. The carrier particles 48 are generally not applied to the photoreceptor 10, but rather remain circulating within housing 44.

In "trickle" type development systems 38 as described above, but also in other types of developer systems, there is provided a replenisher supply source such as a replenishment cartridge 80 which is generally filled with a developer material replenisher 76 including toner 50 and carrier 48. In the present embodiment, the replenishment cartridge 80 is disposed near an auger 31 and in communication therewith. The auger 31 is a component of the replenisher transporter 79 which is also in communication with the interior of the developer housing 44.

FIG. 1 is an exploded view of a replenisher cartridge 80 of a developer system 38. Replenisher cartridge 80 includes the replenisher bottle 78, a bottle dispense assembly 92, a seal cap 102, a filter element 112 and a fill/refill cap assembly 109. As can be seen, in this embodiment the replenisher cartridge 80 is disposed adjacent a plug end 35 of a transfer conduit 84. An auger 31 is disposed within the toner transfer conduit 84 having an end 90 and a lateral opening 86 formed in a portion of the wall 88 of the conduit 84 adjacent the end 90. The portion of the transfer conduit 84 adjacent the end 90 is received through a central opening 104 of the bottle dispense assembly 92 to dispose the lateral opening 86 within the interior of the replenisher cartridge 80 when the cartridge 80 is installed in the printing apparatus 8.

Figure 2:
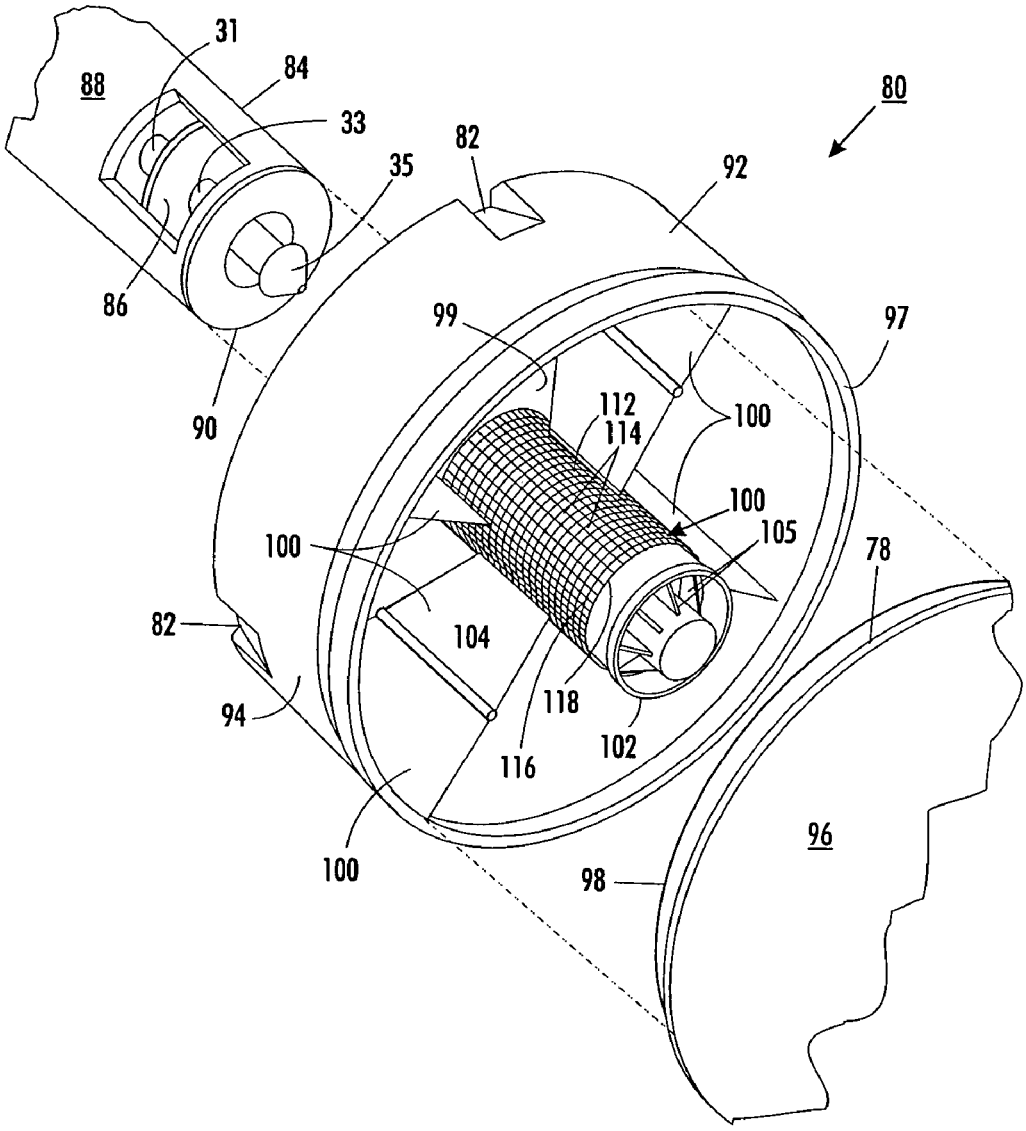
FIG. 2 is a close-up partial exploded view of portions of the filtered replenisher cartridge and replenisher transporter of FIG. 1.
Figure 3:
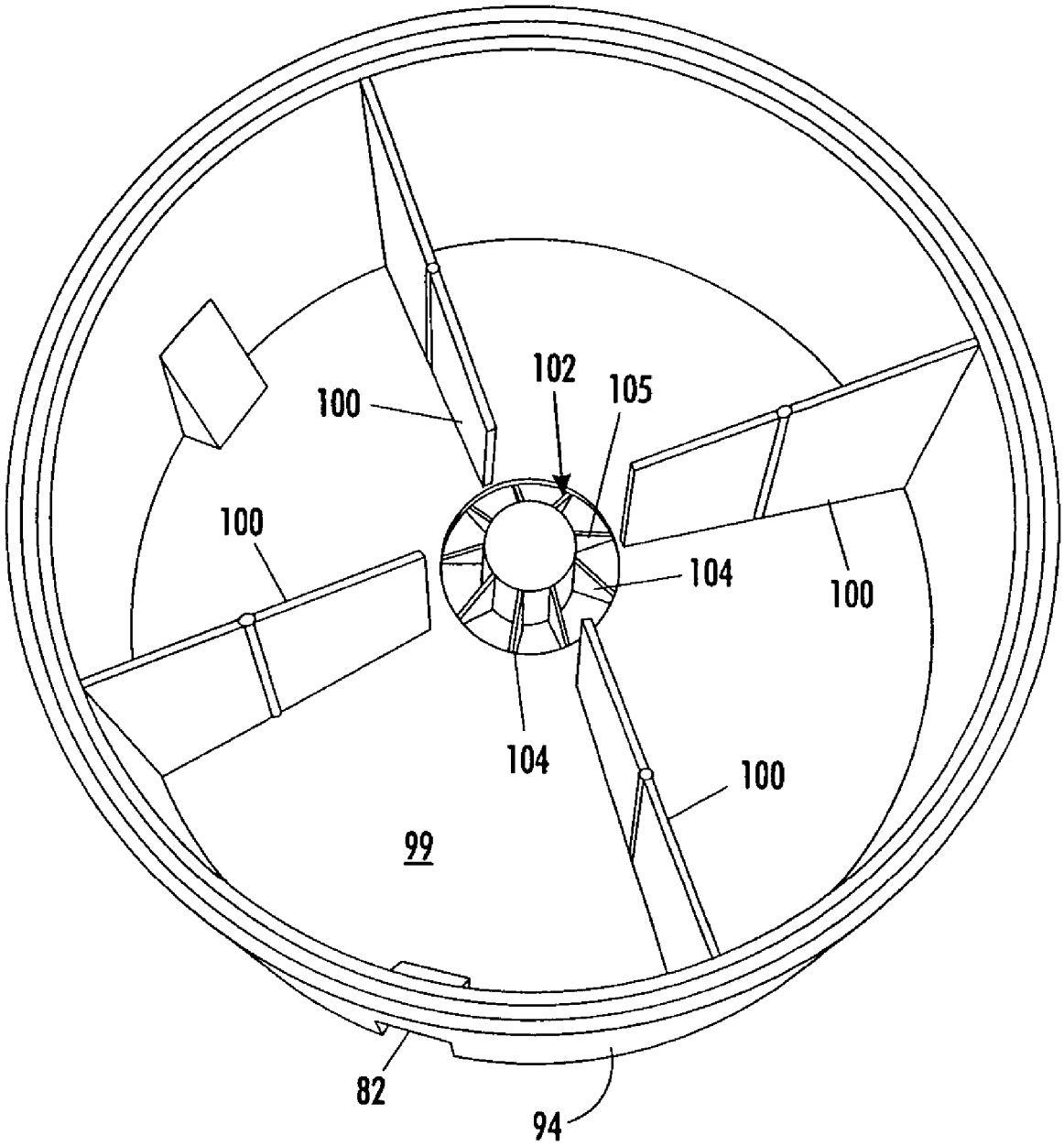
FIG. 3 is a close-up view of the bottle dispense assembly and seal cap of the filtered replenisher cartridge of FIG. 1 (with the filter removed for clarity) prior to insertion of the end of the conduit of the replenisher transport system into the cartridge showing the seal cap sealing a central opening of the bottle dispense assembly.

As shown, for example, in FIGS. 1-3, the bottle dispense assembly 92 is formed to include a cylindrical outside wall 94 having a lip 95 extending from an open end 97 of the bottle dispense assembly 92. The lip 95 has an inside diameter approximately equal to the outside diameter of a cylindrical wall 96 of the replenisher bottle 78. In the illustrated embodiment, the open end 98 of the replenisher bottle 78 is placed within the lip 95 of the dispense assembly 92 and the dispense assembly 92 is joined to the replenisher bottle 78. While in the illustrated embodiment, the dispense assembly 92 is welded to the replenisher bottle 78 it is within the scope of the disclosure for the two components to be joined in other fashions including, but not limited to gluing, bonding or snapping together.

The dispense assembly 92 includes a plurality of blades 100, illustratively four blades, extending radially from a central opening 104. The central opening 104 is sized and shaped to receive either the portions adjacent the end 90 of the transfer conduit 84 therethrough or a seal cap 102 therein. When the seal cap 102 is received in the central opening 104, it acts to seal the replenisher cartridge 80 so that it can be transported and stored without fear of the replenisher 76 leaking through the central opening 104.

Figure 4:
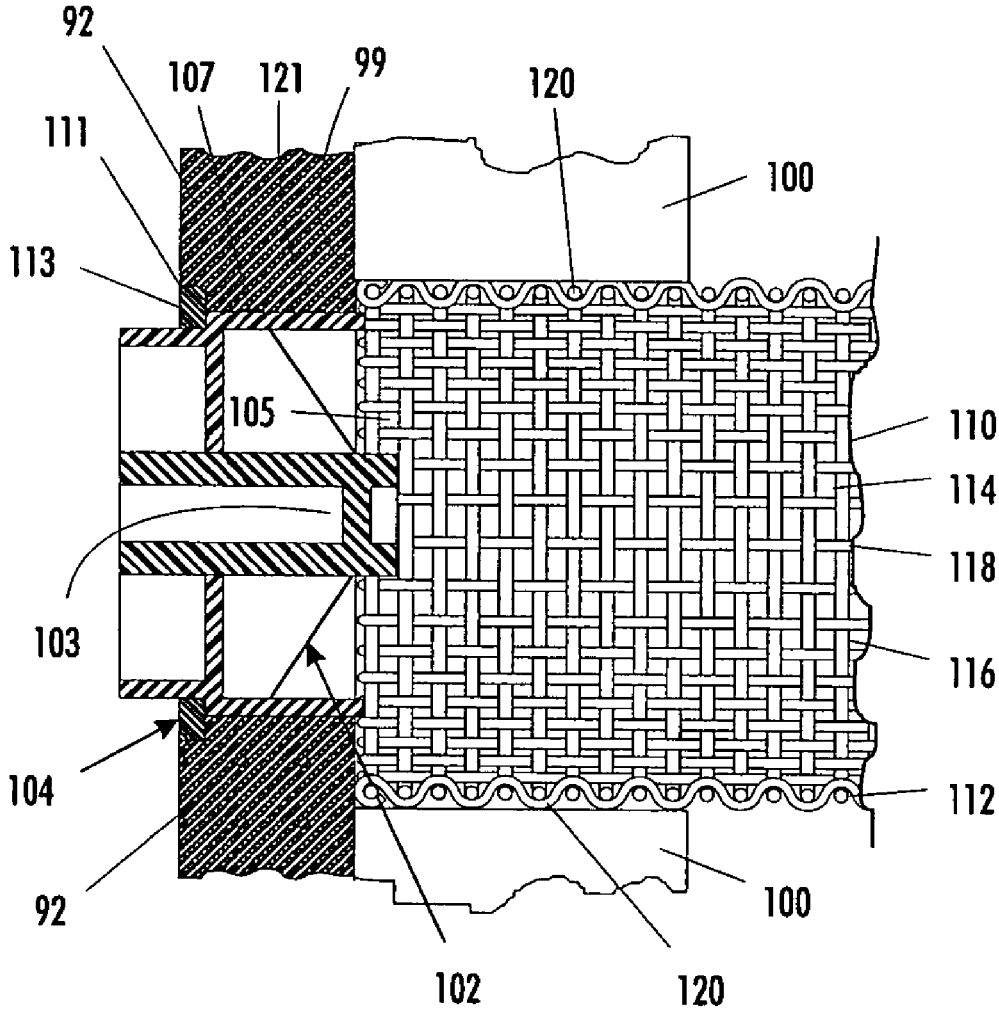
FIG. 4 is a sectional view of the seal cap, filter and a portion of the end wall of the bottle dispense assembly of the filtered replenisher cartridge of FIG. 1.
Figure 5:
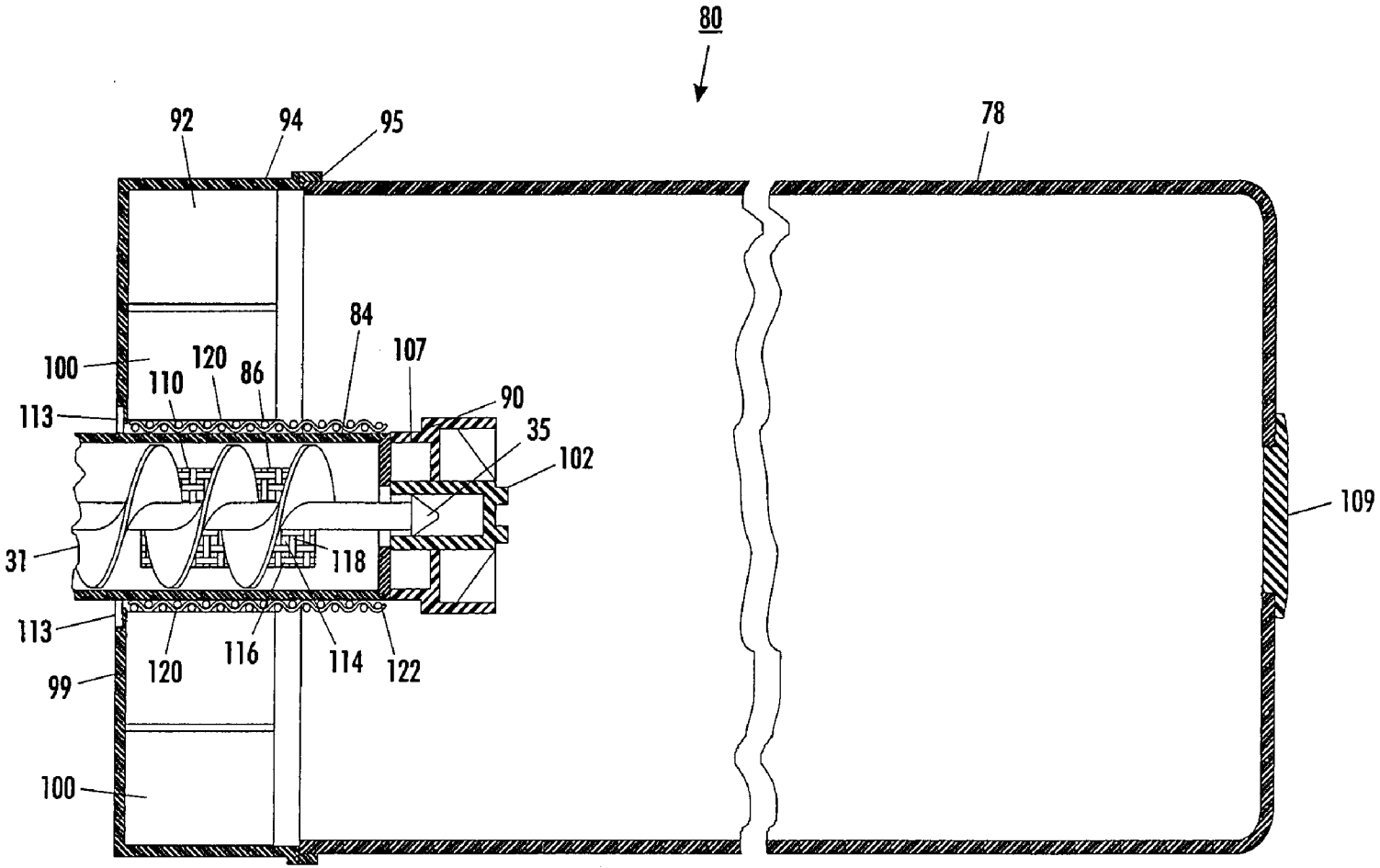
FIG. 5 is a sectional view of the filtered replenisher cartridge (with replenisher removed for clarity) coupled to the replenisher transporter of the development unit.
Figure 6:
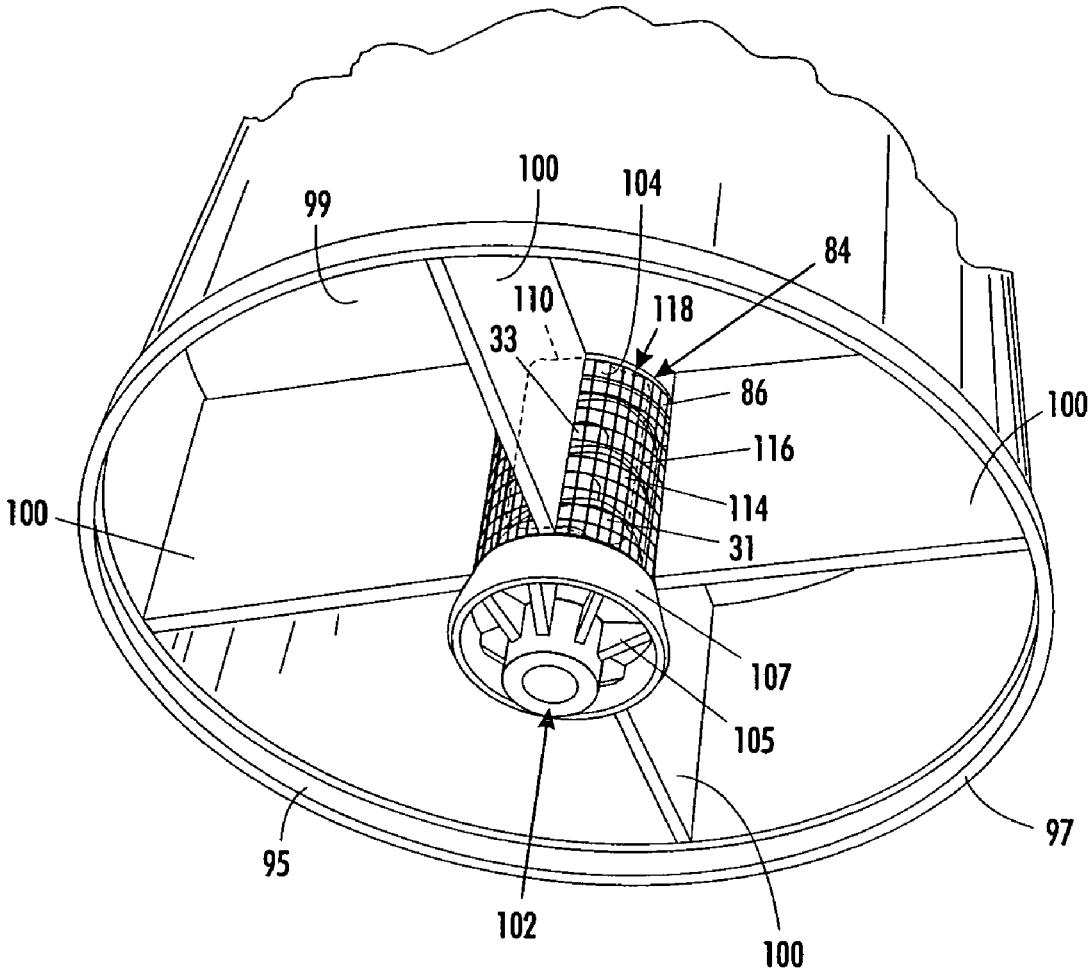
FIG. 6 is a perspective view of portions adjacent an open end of the transfer conduit of the replenisher transporter received in the bottle dispense assembly of the filtered replenisher cartridge.

As shown, for example, in FIG. 4, the cylindrical wall of the central opening 104 is formed to include an annular groove 111 sized to receive a foam seal ring 113 that engages the side wall 107 of the seal cap 102 to provide a seal between the seal cap 102 and the end wall 99 of the dispense assembly 92. Thus, the seal cap 102 is sealed in the central opening 104. This foam seal ring 113 also engages the wall 88 of the transfer conduit 84 to form a seal when the transfer conduit 84 is inserted through the central opening 104 in the closed end wall 99 of the dispense assembly 92, as shown, for example, in FIG. 5.

When the end 90 of the transfer conduit 84 is received in the central opening 104 of the bottle dispense assembly 92, the lateral opening 86 of the conduit 84 is in fluid communication with the replenisher 76 in the replenisher bottle 78. As the transfer conduit 84 is inserted through the central opening 104, the end 90 of the transfer conduit 84 which is formed to include a plug post 35 dislodges the seal cap 102 from the central opening 104. The seal cap 102 contains a central cavity 103 therein sized to receive the plug post 35. When the transfer conduit 84 is inserted through the central opening 104, the plug post 35 enters the cavity 103 and the side wall 107 of the seal cap 102 slides onto the end 90 of the transfer conduit 84, as shown, for example, in FIG. 5.

The seal cap 102 may be formed to include radially extending vanes 105, as shown for example, in FIGS. 1-6, therein. When the conduit 84 is received in the dispense assembly 92, replenisher 76 is allowed to pass from the replenisher bottle 78 through the opening 86 in the transfer conduit 84. The auger 31, disposed within the transfer conduit 84, when rotated, e.g. in the direction of arrow 106, transfers replenisher 76 entering the transfer conduit 84 along the transfer conduit 84 to the developer housing 44.

While the illustrated replenisher cartridge 80 is described as including the replenisher bottle 78 and the bottle dispense assembly 92, it is within the scope of the disclosure for the transfer conduit 84 and auger 31 to be a component of the replenisher cartridge 80. It is also within the scope of the disclosure for the replenisher cartridge 80 to include a transfer conduit and auger that mate with and cooperate with a transfer conduit 84 and auger 31 of the development unit 38.

The blades 100 and the opening 104 are disposed within the interior of the replenisher cartridge 80 when the dispense assembly 92 is joined to the replenisher bottle 78. A motor 46 is used with the cartridge 80 and auger 31 to rotate the auger 31, dispense assembly 92 and it associated blades 100 and replenisher bottle 78 in the direction of arrow 106. The illustrated replenisher cartridge 80 includes a plurality of notches 82 (illustratively two) formed in the closed end wall 99 and cylindrical side wall 94 of the dispense assembly 92. The notches are configured so that a drive tip from a drive mechanism (not shown) powered by the motor 46, or another motor, can be received in one of the notches 82 when the replenisher bottle 80 is mounted in the printer. The illustrated replenisher cartridge 80 is configured to be driven by a drive mechanism such as that found on the iGen3 series of printers available from Xerox Corporation. During this rotation, blades 100 guide replenisher 76 toward the lateral opening 86 of the transfer conduit 84.

In one specific embodiment of a replenisher cartridge 80 for a printer 8, eight pounds of toner 50 and four pounds of carrier 48 are present in the replenisher cartridge 80 when it is full. However, depending on the operational parameters of the printing apparatus in which the replenisher 76 is used, the replenisher bottle 78 could contain replenisher 76 that is one hundred percent toner 50, one hundred percent carrier particles 48 or any other ratio of toner 50 to carrier particles 48. While current replenisher systems typically do not supply replenisher that is one hundred percent carrier particles 48, it is within the scope of the disclosure for a replenisher system to include separate sources of pure toner and pure carrier particles. In most current replenisher systems though, the ratio of toner to carrier particles is typically between 1:1 and 15:1 by weight.

Regardless of the ratio of toner 50 to carrier 48 particles, the replenisher 76 is dispensed from the replenisher cartridge 80 during normal use via lateral opening 86 of the transfer conduit 84 received in the central dispense opening 104 and is conveyed through the transfer conduit 84 by the auger 31. The blades 100 of the dispense assembly 92 are used to guide the replenisher 76 to the center of the replenishment cartridge 80, where the dispense auger 31 from the machine enters the replenisher cartridge 80. Replenisher 76 slides off the four blades 100 through the lateral opening 86 of the conduit 84 passing through the filter element 112. The auger 31 transports the filtered replenisher 76 from the replenisher bottle 78 through the conduit 84 to the chamber of the developer housing 44.

The disclosed toner filter 110 utilizes a filter element 112 disposed over the lateral opening 86 of the transfer conduit 84 when portions adjacent the end 90 of the transfer conduit 84 are received in the replenisher cartridge 80. While illustrated as being located on the outside of the transfer conduit 84 over the lateral opening 86, it is within the scope of the disclosure for the filter element 112 to be disposed between the transfer conduit 84 and the auger 31 disposed therein.

The filter element 112 is configured to include openings 114 therethrough large enough to allow acceptably sized toner 50 and carrier 48 particles to flow through the filter element 112. The openings 114 in the filter element 112 are configured to be small enough to keep oversized flakes of toner 50 and other contaminants from entering the transfer conduit 84 and being transferred to the chamber of the developer housing 44 by the dispense auger 31. In the illustrated embodiment, the filter element 112 comprises a cylindrical wire mesh 116 forming a screen 118.

In the illustrated embodiment, the toner filter 110 comprises screen material 118 formed into a cylindrical wire mesh cage 116. The filter 110 is attached to the inside edge 120 of each of the four blades 100 surrounding the central opening 104 in the bottle dispense apparatus 92. The bottom 121 of the cylindrical cage 116 forming the filter 110 is attached to the closed end wall 99 of the dispense apparatus 92 surrounding the central opening 104, as shown, for example, in FIGS. 4 and 5. In the illustrated embodiment, the screen material 118 forming the filter element 112 is sufficiently rigid so that the top 122 of the cylindrical cage 116 forming the filter 110 is free and extends into the replenisher cartridge 80 when the dispense assembly 92 is joined to the dispense bottle 78, as shown, for example, in FIG. 5.

In one non-illustrated alternative embodiment, the screen material 118 forming the cylindrical cage 116 may be flexible and the top edge 122 of the cylindrical cage 116 may be attached to the seal cap 102 so that the filter element 112 assumes its cylindrical shape as the transfer conduit 84 is inserted into the central opening 104 and dislodges the seal cap 102 from the central opening 104. In yet another non-illustrated embodiment, the screen material cage 116 may be inserted over the portion of the transfer conduit 84 adjacent the end 90 with the screen material 118 extending over the lateral side opening 86 prior to inserting the transfer conduit 84 into the central opening 104 of the dispense assembly 92 of the cartridge 80. It is within the scope of the disclosure for the filter 110 to be formed from other materials and to be disposed anywhere within the flow path of the replenisher 76 from the cartridge 80 to the chamber of the developer housing 44.

In the illustrated embodiment, the openings 114 in the wire mesh 116 are approximately two hundred microns so that flakes of toner 50 and contaminants having a maximum dimension larger than two hundred microns cannot pass through the filter element 112. It is within the scope of the disclosure for the size of the openings 114 in the filter element 112 to range from one hundred microns to one thousand microns. The size of the openings 114 in the filter element 112 may be adjusted through experimentation to achieve the desired print quality from the printer.

Oversized flakes of toner 50 and contaminants are rejected by the filter element 112 and remain in the replenisher bottle 78. Even if not completely effective in eliminating contaminants and oversized toner flakes from entering the chamber of the developer housing 44, the filter element 112 reduces the number of oversized toner flakes and other contaminants that enter the printing system, making the printing system more robust.

Upon depletion of the replenisher 76 in the replenisher cartridge 80, the replenisher cartridge 80 can be removed from the transfer conduit 84 and either replaced with a new or refurbished cartridge or refilled. During removal of the replenisher cartridge 80 from the transfer conduit 84, the seal cap 102 is configured to be reseated in the central opening 104 of the bottle dispense apparatus to reseal the cartridge 80. Upon removal of a replenisher cartridge 80, the cartridge 80 may be refilled or remanufactured.

During refilling or remanufacturing, the replenisher cartridge 80 is opened and emptied of remaining toner particles 50, carrier particles 48 and debris. The replenisher cartridge 80 may be opened by removing the fill/refill cap assembly 109 or by separating the dispense assembly 92 from the replenisher bottle 78. Where, as illustrated, the replenisher cartridge 80 includes an internal filter 110, during remanufacturing, the filter 110 is then typically inspected for damage or wear. If the filter element 112 is damaged or worn it is replaced. If the filter element 112 is not damaged or worn, oversized particles or contaminants may be removed from the filter element 112 and the filter element 112 may then be returned to the cartridge 80.

The seal cap 102, if not reseated during removal of the transfer conduit 84 or if unseated during opening of the cartridge 80, is then reseated in the central opening 104 of the dispense apparatus 92. The cartridge 80 is then refilled with replenisher 76 having the desired ratio of toner particles 50 to carrier particle 48. The cartridge 80 is then reassembled by resealing the bottle 78 to the dispense assembly 92 or by replacing the fill/refill cap assembly 109, depending on the manner in which the cartridge 80 was opened. The refilled or remanufactured cartridge 80 is then packaged and sent back to distribution.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An apparatus for developing an electrostatic latent image employed in a printing machine including:

a photoreceptor configured to receive a latent image and attract toner particles to the latent image;

a developer unit positioned proximate to the photoreceptor, the developer unit including a developer housing for holding a supply of developer material that includes toner particles;

a replenisher supply source having an internal volume that contains toner particles, the replenisher supply source having an opening;

a replenisher transporter having one end located at the opening of the replenisher supply source to receive toner particles from the replenisher source supply and another end in communication with the developer housing for transporting toner particles from the replenisher supply source to the developer housing; and a filter at the end of the replenisher transporter that is located at the replenisher supply source opening, the filter being configured to limit the particles discharged from the replenisher supply source opening into the replenisher transporter to a maximum size.

2. The apparatus of claim 1 wherein the replenisher transporter comprises a transfer conduit and an auger disposed within the transfer conduit.

3. The apparatus of claim 2, the replenisher supply source comprises a cartridge with the opening through which toner particles pass to enter the replenisher transporter and the cartridge includes at least one blade that rotates with the auger of the replenisher transporter to direct the toner particles in the cartridge towards the opening in the cartridge when rotated.

4. The apparatus of claim 3, the filter being located across the opening to inhibit particles greater than the maximum size from entering the opening except through the filter.

5. The apparatus of claim 4 wherein the filter includes a mesh formed to include openings limiting the particles that may pass through the filter to the maximum size.

6. The apparatus of claim 5 wherein the openings in the mesh are sized to inhibit particles having a dimension greater than about one thousand microns from passing through the filter.

7. The apparatus of claim 6, the filter being located within the cartridge and across the opening.

8. The device of claim 6, the filter being located within the transfer conduit of the replenisher transporter and proximate a lateral opening in the one end of the transfer conduit, which extends into the cartridge.

9. The apparatus of claim 1, the filter being located within the replenisher supply source and across the opening of the supply source.

10. The device of claim 1, the filter being located within the replenisher transporter and proximate a lateral opening in the one end of the replenisher transporter at the opening in the replenisher supply source.

11. A replenisher cartridge for supplying replenisher to a developer unit of an electrophotographic printing machine, the replenisher cartridge comprising:

a container configured to receive one end of a replenisher transporter, the container having an opening through which replenisher from the container is provided to the replenisher transporter;

a filter element disposed relative to the opening in the container to filter replenisher as it is provided to the replenisher transporter.

12. The replenisher cartridge of claim 11 wherein the filter element is disposed across the opening.

13. The replenisher cartridge of claim 11 the container being configured to receive a transfer conduit of the replenisher transporter and the filter element is cylindrical and mounted within the container to cover a lateral opening in the transfer conduit.

14. The replenisher cartridge of claim 13, the container including at least one blade that rotates about the cylindrical filter element to urge replenisher towards the filter element.

15. The replenisher cartridge of claim 14, the cylindrical filter element having a displaceable seal cap in one end.

16. The replenisher cartridge of claim 15, the container including a notch for engaging a motor drive to rotate the at least one blade positioned adjacent the cylindrical filter element.

17. A method for supplying replenisher to an electrophotographic machine comprising:

displacing a seal cap in a replenisher supply cartridge with one end of a transfer conduit of a replenisher transporter of an electrophotographic machine;

filtering particles moving from the replenisher supply cartridge to the one end of the transfer conduit so particles greater than a maximum size remain in the cartridge.

18. The method of claim 17 further comprising:

inserting the one end of the transfer conduit into a cylindrical filter within the cartridge so the cylindrical filter covers a lateral opening in the one end of the transfer conduit.

19. The method of claim 18 further comprising:

rotating a blade within the cartridge to urge particles less than the maximum size through the cylindrical filter.

20. The method of claim 19 further comprising:

rotating an auger within the transfer conduit to move particles passing through the cylindrical filter into the lateral opening of the transfer conduit to another end of the transfer conduit to supply toner particles to a development housing.

* * * * *